United States Patent [19]

Ajioka

[11] Patent Number: 4,872,020

[45] Date of Patent: Oct. 3, 1989

[54] SLOT ANTENNA IN CIRCULAR WAVEGUIDE

[75] Inventor: James S. Ajioka, Fullerton, Calif.

[73] Assignee: Hughes Aircraft Company, Los Angeles, Calif.

[21] Appl. No.: 260,560

[22] Filed: Oct. 20, 1988

Related U.S. Application Data

[62] Division of Ser. No. 6,533, Jan. 23, 1987, Pat. No. 4,825,219.

[51] Int. Cl.[4] ..... H01Q 13/10

[52] U.S. Cl. ..... 343/771; 343/768

[58] Field of Search ..... 343/746, 767, 768, 770, 343/771

[56] References Cited

U.S. PATENT DOCUMENTS

| | | | |
|---|---|---|---|
| 3,646,589 | 2/1972 | Poitevin | 343/771 |
| 3,720,953 | 3/1973 | Ajioka | 343/771 |
| 3,775,771 | 11/1973 | Scherer | 343/770 |
| 4,079,361 | 3/1978 | Woode | 343/771 |
| 4,266,228 | 9/1981 | Perrotti | 343/771 |
| 4,613,869 | 9/1986 | Ajioka et al. | 343/771 |
| 4,825,219 | 4/1989 | Ajioka | 343/771 |

*Primary Examiner*—J. Carroll
*Assistant Examiner*—Doris J. Johnson
*Attorney, Agent, or Firm*—T. A. Runk; W. K. Denson-Low

[57] ABSTRACT

Disclosed is a circular waveguide in which a slots are formed which are shaped and disposed such that they interrupt either the right hand or left hand circulating mode (RC and LC respectively) residing in the waveguide. Locating the slots in the waveguide wall is accomplished in accordance with the theory that for TE modes in circular waveguide with circumferential variation of $e^{\pm jm\phi}$, current flow lines are produced that are helical. The slots are located so as to interrupt the helical current of the desired mode. In one embodiment, an ortho-polarization mode transducer and a circular polarizer are used to feed the slotted waveguide. By control of the amplitude and phase of the energy propagating in the waveguide, azimuthal pattern control can be effected. By dielectric loading the waveguide to make λg in the loaded waveguide equal to λ-free space, endfire radiation can be achieved.

14 Claims, 3 Drawing Sheets

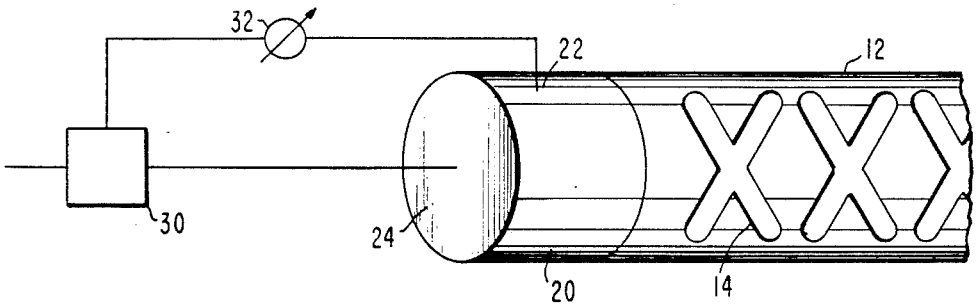
Fig. 2.
Fig. 3.
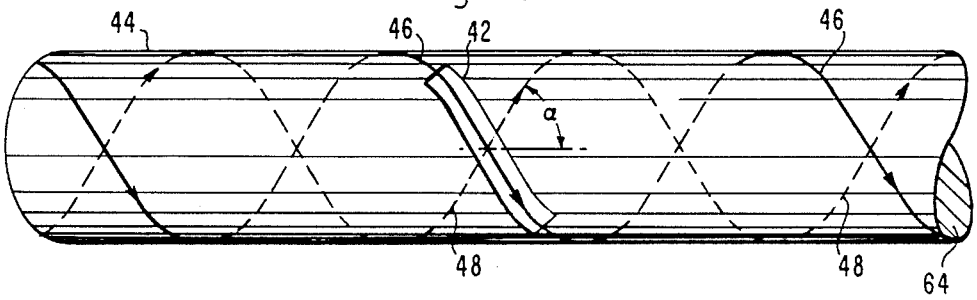
Fig. 4.
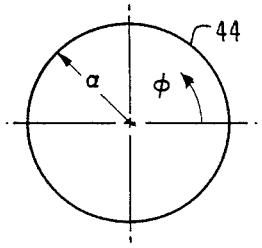
Fig. 5.
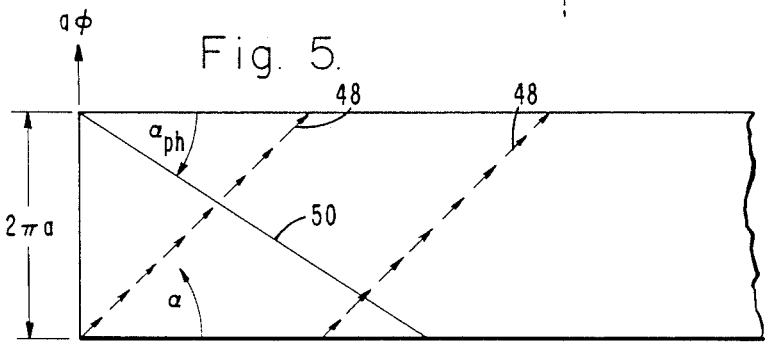

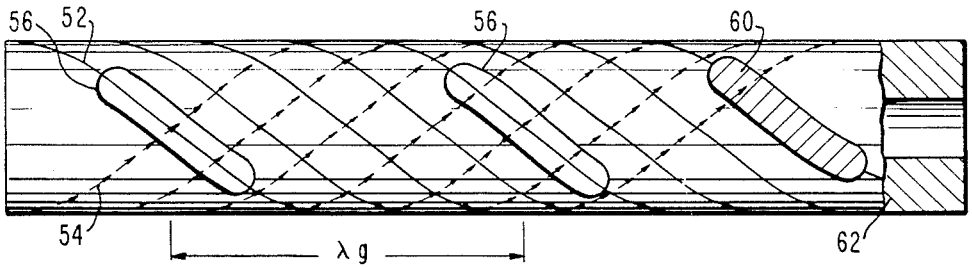
Fig. 6.
Fig. 8.
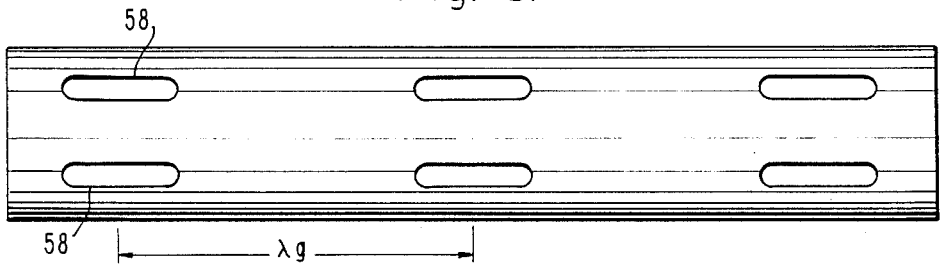
Fig. 9.
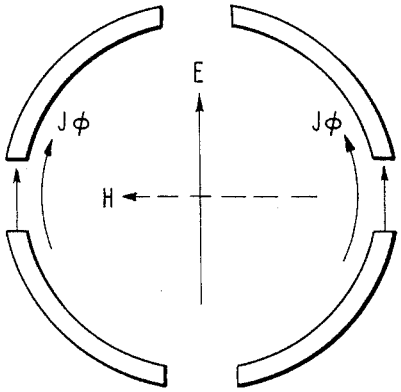

SLOT ANTENNA IN CIRCULAR WAVEGUIDE

This is a division of application Ser. No. 07/006,533 filed Jan. 23, 1987, now U.S. Pat. No. 4,825,219.

BACKGROUND OF THE INVENTION

The invention relates generally to the field of antennas, and more particularly, to slotted waveguide antennas.

A relatively large amount of research has been conducted on slotted, rectangular waveguide antennas and frequent reports have been made in the literature. For instance, see Johnson and Jasik, *Antenna Engineering Handbook,* 2ed., McGraw-Hill 1984, chapter 9, and S. Silver, *Microwave Antenna Theory and Design,* MIT Radiation Laboratory Series, pp. 287–301. Many of these antennas use probes to excite the slots. As is well known, probes have disadvantages including the potential for arcing at high power levels and difficulty in manufacture and assembly.

There has also been a moderate amount of research and reporting on slotted coaxial waveguide antennas operating in the fundamental TEM mode and on circular waveguides operating in the $TM_{01}$ mode. See S. Silver, MIT Radiation Laboratory Series, Vol. 12, *Microwave Antenna Theory and Design* pp. 305–309, 325, and 328 and in Johnson and Jasik, *Antenna Engineering Handbook,* 2ed., pp. 28–15. These designs have fixed linear polarization and do not have azimuthal pattern control. Also see Cornbleet, "The Helical Slot Antenna," IEE Third International conference on Antennas and Propagation, ICAP 1983, Part I.

Prior coaxial line slot antennas typically operated in the TEM mode in coaxial line or in the $TM_{01}$ mode in circular waveguide with the slots coupled by associated probes. The antenna had fixed transverse linear polarization. In these types of antennas, the slots are parallel to the longitudinal current flow lines of the TEM or $TM_{01}$ modes, hence they would not radiate without probes that project into the waveguide.

Very little has been reported about slotted circular waveguide antennas without probe excitation except for long continuous slots to form a "leaky wave antenna" as reported in J. N. Hines, V. H. Rumsey, and C. H. Walter, "Traveling-Wave Slot Antennas," Proc. IRE, Vol. 41, 1953, p. 1629, FIG. 11. Also see J. S. Ajioka and G. M. Coleman, U.S. Pat. No. 2,818,565. A very wide, continuous longitudinal slot was used in circular waveguide and operation occurred in the $TM_{01}$ mode. Narrow longitudinal slots would not radiate because they were parallel to the current flow lines (TM modes have longitudinal currents only). Very wide slots, where the width was on the order of the radius of the waveguide or wider, perturbed the guided wave enough to cause leakage from the waveguide.

All of the above-mentioned techniques have the disadvantage of fixed polarization transverse to the array. The discrete slot array technique has the further disadvantage of requiring the use of costly, high power limiting electric probes which are used to excite the slots. The continuous slot technique has the further disadvantage of radiation at neither broadside nor at endfire but at somewhere in between. The beam direction is generally determined by $\sin\theta=\lambda/\lambda_g$.

Thus, it would be an advance in the art to provide an antenna which may radiate at relatively high power levels, which does not use coupling probes, which has controllable polarization, and which allows azimuthal pattern control.

In view of the above, it would also represent an advance in the art to provide a slotted circular or coaxial waveguide antenna having controllable polarization and azimuthal pattern control.

It is an object of the invention to provide a new and improved slotted, circular or coaxial waveguide antenna.

It is also an object of the invention to provide a circular or coaxial slotted waveguide antenna having controllable azimuthal patterns.

It is also an object of the invention to provide a slotted, circular or coaxial antenna that takes advantage of helical current flow lines for circumferential TE modes with circumferential variation greater than zero.

It is also an object of the invention to provide a slotted, circular or coaxial antenna which can provide beams from broadside to endfire with arbitrary or controllable polarization.

SUMMARY OF THE INVENTION

These and other objects and advantages are attained by the invention wherein there is provided a circular or coaxial waveguide having a slot shaped such that it interrupts the current flow lines of either the right hand or left hand circulating mode (RC and LC respectively) residing in the waveguide, and having a control means to control the relative magnitude and phase between the two circulating waves. By this technique, arbitrary polarization may be radiated.

In one embodiment, the control means includes an ortho-polrization mode transducer and a quarter wave plate, circular polarizer feeding the slotted waveguide.

The slots formed in the waveguide to interrupt the RC and the LC are not necessarily perpendicular to one another but are independently positioned so that any polarization can be generated by a particular combination. The slots have nominal $\lambda_g$ spacing for broadside radiation. By dielectrically loading the waveguide to make $\lambda_g$ in the loaded waveguide equal to $\lambda$-free space, endfire radiation can be achieved.

The positions of the slots in the waveguide wall are selected in accordance with the theory that for TE modes in circular waveguide with circumferential variation of $e^{\pm jm\phi}$, purely helical current flow lines exist in the walls of the waveguide. The slots are located so as to interrupt these current flow lines of the desired mode so that radiation of that mode will occur. By forming a plurality of slots which are disposed at predetermined distances from one another in the waveguide, both the LC and RC modes may be interrupted and so radiate together. By controlling the relative amplitude and phase between the two circulating modes, the azimuthal pattern can be rotated and so moderately changed in directivity.

BRIEF DESCRIPTION OF THE DRAWINGS

For a more detailed description of the invention, reference is now made to the following description of the preferred embodiment and the accompanying drawings wherein:

FIG. 2 presents a perspective view of the antenna of FIG. 1 showing amplitude and phase controls for the two ports of the ortho-polarization mode transducer;

FIG. 3 presents an oblique view of a section of circular waveguide containing a slot formed in alignment with a helical line on the waveguide surface. Helices of two senses are shown;

FIG. 4 presents an end view of FIG. 3 showing the characteristics represented by certain symbols;

FIG. 5 presents a developed view of FIG. 3 showing an equi-phase line and lines representing helices of FIG. 3;

FIG. 6 presents an oblique view of a section of coaxial waveguide having two slots formed which are in alignment with certain helices representing currents of one sense. Also shown are helices in dashed lines which represent currents of a second sense;

FIG. 8 presents a side view of a section of circular waveguide having longitudinal slots formed in the walls for coupling to both the LC and RC waves; and FIG. 9 presents a schematic end view of a circular waveguide showing the characteristics described by certain symbols used in the following text.

DESCRIPTION OF THE PREFERRED EMBODIMENT

Figure 1:
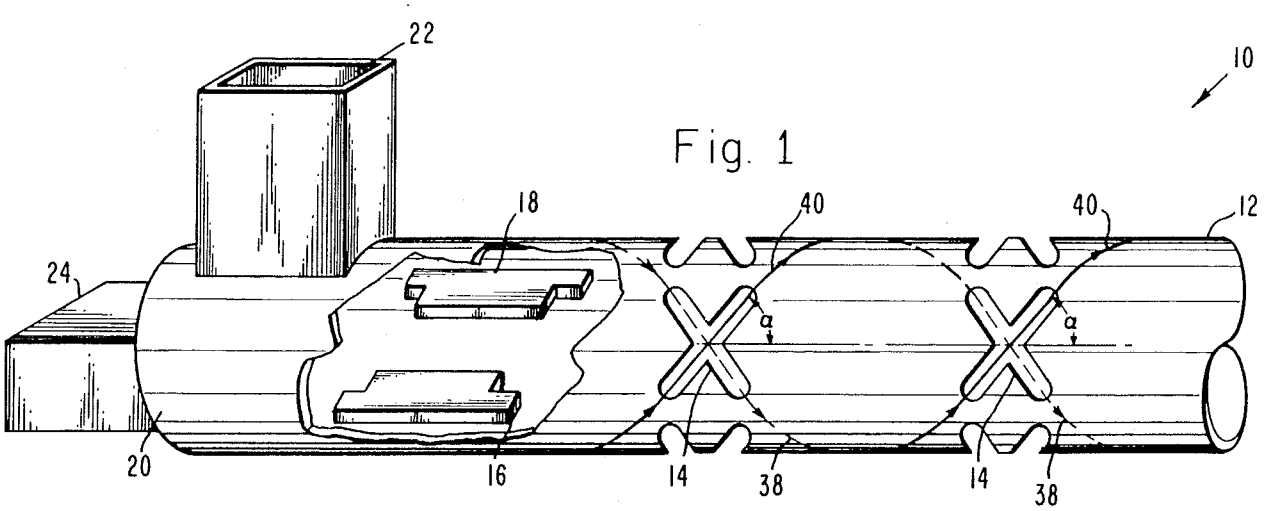
FIG. 1 presents a slot antenna in circular waveguide in accordance with the invention in a perspective view. The circular waveguide is fed with an ortho-polarization mode transducer and includes a circular polarizer adjacent the transducer. A plurality of crossed slots are shown to obtain the desired radiation pattern.

In the following description, like reference numerals will be used to refer to like or corresponding elements in the different figures of the drawings. Referring now to the drawings with more particularity, FIG. 1 presents a slot antenna 10 in circular waveguide in accordance with the invention. Circular waveguide 12 includes "X-shaped" or "crossed" slots 14 for interrupting the currents in the waveguide 12. These slots are formed at positions selected so that they interrupt the desired component of the left-hand circulating (LC) and right-hand circulating (RC) modes thereby causing a particular combination of these modes in the radiated energy.

In FIG. 1, a plurality of crossed slots 14 are shown. Their locations in relation to each other and to the orientation of the waveguide 12 are selected to obtain the required radiation pattern. Also shown in the cutaway portion of the waveguide 12 is a quarter-wave plate, circular polarizer comprised of ridges 16 and 18 for causing circular polarization in energy introduced into the waveguide 12 for radiation out of the slots 14. Devices functioning as circular polarizers 16 and 18 are well known to those skilled in the art and include ridges.

FIG. 1 also includes an ortho-polarization mode transducer 20 at the left of the dashed lines on the waveguide 12. The transducer 20 includes a right hand circular polarization port 22 and a left hand circular polarization port 24. Devices functioning as ortho-polarization mode transducers are well known to those skilled in the art and no further detail is given here.

By controlling the amplitude and phase of the energy input to the two ports of the ortho-polarization mode transducer 20, a particular combination will result at the crossed slots, which will interrupt this energy and cause radiation. By adjusting the characteristics of the energy input to one or both ports of the ortho-polarization mode transducer 20, azimuthal pattern control may be effected.

Shown in FIG. 2 is another means of controlling the azimuthal pattern. A power splitter 30 is used to split the input energy in preselected parts. One part of the split power is fed directly to port 24 of the ortho-polarization mode transducer 20 while the second part of the split power is input to a phase shifter 32. After being phase shifted by a selected amount, the second part of the split power is input to the second port 22 of the ortho-polarization mode transducer 20.

As is well known to those skilled in the art, slot radiators in waveguide walls couple to the modal fields in the waveguide by the degree to which the slot interrupts the radio frequency (RF) currents in the waveguide wall. If the slot is perpendicular to a component of the RF current, the slot will be excited and will radiate. If the slot is parallel to the RF current in the waveguide wall, it will cause only a minor perturbation, if any, to the waveguide field and will not couple and hence, not significantly radiate. See S. Silver, *Microwave Theory and Design,* MIT Radiation Laboratory Series, Vol. 12, p. 287 and Johnson and Jasik, *Antenna Engineering Handbook,* 2ed., McGraw-Hill, sec. 9-2.

It is to be understood that the law of reciprocity applies and that the invention may be used for both transmission and reception of energy. Descriptions contained herein which indicate the use of an embodiment of the invention for radiation are not to be construed that the antenna is operable only for radiation. The description used is only for convenience in specifying the operation of the invention and the invention is also operable for reception.

In the invention, the slots 14 are located so as to interrupt the flow of TE mode currents in the waveguide 12. In the circular waveguide 12, the slots 14 are located along helices which represent the current flow lines. For TE modes in circular waveguide with circumferential variation of $e^{\pm jm\phi}$, current flow lines are produced in the walls of the waveguide that are purely helical and have either left hand screw sense corresponding to $e^{+jm\phi}$ or right hand screw sense corresponding to $3^{-jm\phi}$. These two modes are independent and mathematically orthogonal to each other. The slot are located in accordance with these helices in the invention.

As shown in FIG. 1, current flow lines follow a helical path around the circular waveguide 12. The solid lines 38 represent right-hand circulating modes RC and the dashed lines 40 represent left-hand circulating modes LC. The arrowheads are used for convenience only to show the instantaneous direction of flow of the currents in this figure and are not meant to be restrictive of the invention.

Although crossed slots 14 are shown in FIG. 1, this is one embodiment only. Other types of slots may be used depending upon the particular application. For example, a single slot 42 such as that shown in FIG. 3 may find application. As in FIG. 1, helices have been drawn on the waveguide 44 in FIG. 3 and these helices present both the RC mode in solid lines 46 and the LC mode in dashed lines 48. As is shown, the slot 42 follows the helical path of the RC mode line 46. Thus, little of this mode is radiated or received, however, the LC mode 48 is interrupted and radiation and reception of that mode may occur.

Although not intending to be bound by theory, the following more detailed discussion is presented to provide background for the slot operation.

Circular waveguide with transverse electric (TE) to Z modes with circumferential variation of $e^{\pm jm\phi}$ will be considered. As was discussed above, the current flow lines in the walls of the waveguide are produced that are purely helical. The left hand screw sense corresponds to:

$$e^{+jm\phi}$$

and right hand screw sense corresponding to:

$$e^{-jm\phi}$$

These two modes are independent and are mathematically orthogonal to each other. The location of the slots take advantage of the helical current flow and the independence of the left and right screw senses. The field components of these modes are:

$$H_z = J_m(k_c r)e^{j(\omega t - m\phi - K_g Z)}$$

where:

$k_c$=cutoff wave number=$(2\pi)/\lambda_c$
$k_c a$=m'th non-zero root of $J'_m(x)$
a=radius of waveguide
m=wave number in $\phi$
$K_g$=wave number in z=$(2\pi)/\lambda_g$
$K_g = K^2 - K_2^2$
$\mu$=magnetic permeability of the medium Deleting the exponential, the field components become:

$$E_r = \frac{-mw\mu}{K_c^2 r} J_m(K_c r)$$

$$E_\phi = \frac{jw\mu}{K_c} J'_m(K_c r)$$

$$E_z = 0$$

$$H_r = \frac{-jK_g}{K_c} J'_m(K_c r)$$

$$H_\phi = \frac{-mK_g}{K_c^2 r} J_m(K_c r).$$

For the moment, consider a traveling wave in the Z direction:

$$e^{-jK_g Z}$$

and circulating in the $\phi$ direction:

$$(e^{-jm\phi})$$

In the following discussion, the $\phi$ dependence, $e^{-jm\phi}$ will be designated as right-hand circulating modes (RC) and $(e^{+jm\phi})$.

as left-hand circulating modes (LC). For the dominant mode ($TE_{11}$) in circular waveguide, $e^{-j\phi}$ corresponds to the right hand circular polarization in the waveguide and $e^{+j\phi}$ corresponds to left-hand circular polarization in the waveguide. For higher order m-modes, the term "circular polarization" (CP) is not applicable and the term "circulating modes" will be used instead.

The direction of the surface current flow lines in the waveguide is determined by the following:

$$\tan\alpha = \frac{J_\phi}{J_z} \text{ by } \bar{J} = \bar{n} \times \bar{H},$$

$$n \times H = \hat{r}(0) + \hat{\phi}(-H_z) + \hat{z}H_\phi$$

(carets designate unit coordinate vectors) and $$\tan\alpha = \frac{-H_z}{H_\phi}\Bigg]$$

at r=a where n is the inward unit normal to the waveguide wall and $\alpha$ is the angle between the direction of current flow lines and an element of the cylinder of the waveguide as shown in FIGS. 3, 4, and 5 where the solid line 46 designates the current flow line for RHCP, and the dashed line 48 designates the current flow line for LHCP. FIG. 4 is an end view of FIG. 3 and FIG. 5 is a developed view of FIG. 3.

In FIG. 5, it is seen that the direction of the current flow lines 48 is a constant, independent of Z, O, or time.

$$\tan\alpha = \frac{2\pi a}{m} \frac{\lambda_g}{\lambda_c^2}$$

This represents a helical current sheet with pitch angle $\alpha$. If the waveguide wall is flattened out (developed) into a plane as shown in FIG. 5, the current flow lines are straight lines with slope tan $\alpha$ as shown by the dashed lines 48. The current flow lines that correspond to the opposite sense of circulation are at angle $-\alpha$.

The lines of constant phase or phase contours are determined by:

$$K_g Z + \frac{ms}{a} = 0$$

where: s=the circumferential distance on the waveguide wall $$\tan\alpha_{ph} = \frac{S}{Z} = -\frac{K_g a}{m} = -\frac{2\pi a}{m\lambda_g}.$$

The constant phase contours are also helices but with opposite sense and different pitch angle $\alpha_{ph}$. As with the current flow lines, the constant phase lines for the opposite sense of circulation are symmetrically oriented with respect to a cylinder element. One such equi-phase line 50 is shown in FIG. 5.

It was noted that the magnitudes of $\alpha$ and $\alpha_{ph}$ are, in general, not equal. They are equal when the cutoff wavelength $\lambda_c$ is equal to the guide wavelength $\lambda_g$. This occurs at the mid operating band of a given waveguide mode. Also the current flow lines and the constant phase lines are not, in general, orthogonal. At cutoff, the current flow lines are purely circumferential and the constant phase lines are purely longitudinal ($\alpha$=90 degrees and $\alpha_{ph}$=0). At cutoff the wave circulates and does not propagate down the guide. Far from cutoff, as the frequency or waveguide radius "a" approaches infinity:

$\alpha \rightarrow 0$ and $\alpha_{ph} \rightarrow 90$ degrees.

The wave propagates down the waveguide axis with a transverse phase front and with the free space velocity.

The direction of the Poynting vector $\overline{E}\times\overline{H}$ is in the same direction as the current flow lines because $\overline{E}$ is purely transverse as is the unit normal $\overline{n}$. Therefore:

$$\overline{J}=\overline{n}\times\overline{H} \text{ and}$$

$$\overline{S}_{av}=\tfrac{1}{2}\mathrm{Re}\ \overline{E}\times\overline{H}^*$$

at the waveguide wall are parallel.

$$2S_{av} = E \times H^* = \hat{\phi}(-E_r H_z^*) + \hat{z}(E_r H^*),$$

$$E_\phi = 0 \text{ at } r = a$$

$$\tan S = \frac{S_\phi}{S_Z} = \frac{-H_Z^*}{H_\phi}$$

which is identical to tan $\alpha$.

Figure 7:
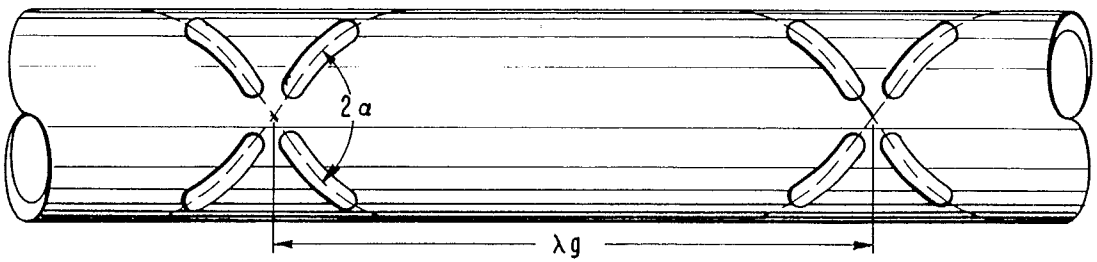
FIG. 7 presents an oblique view of a section of circular waveguide having two pairs of slots formed in the waveguide walls for achieving arbitrary polarization of the radiated beam.

In the developed waveguide shown in FIG. 5, the current flow lines for $+\alpha$ and $-\alpha$, ($-$m and $+$m) correspond to oppositely circulating waves and are simply straight lines. In nearly all references on electromagnetics, the current flow lines that are pictorially shown are the resultant interference pattern when these simple current flow lines are superposed which corresponds to cos m$\phi$ or sin m$\phi$ circumferential variation instead of $e^{\pm jm\phi}$ variation. These current flow lines with cos m$\phi$ or sin m$\phi$ variation are quite complex in configuration and vary as a function of Z, $\phi$, and time and, in general, are elliptically polarized. In the former case of circulating waveguide waves, a circular hole cut anywhere in the waveguide would be linearly polarized parallel to the current flow lines. Current flow lines for RC 52 (solid lines) and for LC 54 (dashed lines) depicted in FIG. 6 suggests that if a slot 56 were cut parallel to say, the RC current flow line (solid line), it would not interrupt the current flow and would not couple to the RC wave. However, the slot 56 does interrupt the current flow lines corresponding to LC (dashed lines), therefore it would couple and radiate into free space. The polarization is essentially slant linear. It would be exactly slant linear if the active element had a null in the direction opposite the slot. Likewise, if another slot were cut parallel to the current flow lines of the LC wave, it would couple to the RC wave. Such an arrangement is shown in FIG. 7. Thus, by independently controlling the relative magnitude and phase between the two circulating waves, arbitrary polarization could be radiated. For the dominant $TE_{11}$ mode this could easily be done, for example, by the use of the orthopolarization mode transducer and a quarter-wave plate circular polarizer feeding the slotted waveguide. One port of the orthomode transducer is used for one sense of circular polarization and the other port is used for the other sense. In general, the slots for the two modes are not perpendicular to each other, but they are independent (neglecting external mutual coupling) and can be independently controlled so that any polarization can be generated by the proper combination.

For circular polarization, the phase between the slots for the two modes would not be 90 degrees but would be equal to the physical angle $2\alpha$ between the slots. If such slots are spaced nominally $\lambda_g$ apart along the waveguide, a linear array with high directivity broadside to the axis of the waveguide would result. If such a linear array were duplicated around the circumference of the waveguide the antenna would be omni-directional in the transverse plane in the sense that the power radiated is omni-directional. However, the polarization changes as a function of $\phi$. Since one sense, say RC, couples to slots of angle $+\alpha$ and has phase of $e^{-jm\phi}$ and the slots of angle $-\alpha$ have phase of $e^{+jm\phi}$, the relative phase between slots corresponding to the two modes would change by 2m$\phi$ as we go around the waveguide. The polarization would change from circular of one sense, linear, circular of the opposite sense, linear, back to circular and various ellipticities in between. This cycle is repeated m times for full revolution in $\phi$.

Another configuration shown in FIG. 8 is to have longitudinal slots 58 approximately equal to $\lambda_g$ part axially and circumferentially disposed. In this case, each slot 58 couples equally to both the RC and LC waves. The pattern would be broadside as before. In the circumferential plane, the pattern would be multi-lobed according to cos m$\phi$. For m$=1$, it would be a figure eight pattern with two diametrically opposing maxima and two diametrically opposing nulls. By changing the relative phase between the RC and LC waves, this pattern can be rotated in $\phi$. This array could be used for direction finding.

The waveguide slot arrays previously described have nominal $\lambda_g$ axial spacing for broadside radiation. By dielectric loading 64 the waveguide (FIG. 3) to make $\lambda_g$ in the loaded waveguide equal to $\lambda$-free space (or slightly less for the Hansen-Woodyard condition), endfire radiation could be achieved. Consider a slot array of the kind shown in FIG. 7 except that the waveguide is dielectrically loaded for endfire, the slots need not be axially spaced by $\lambda_g$ but can be arbitrarily spaced. Also, if such an array is duplicated around the circumference of the waveguide, they can be axially staggered without affecting endfire phasing. Such an array could, in principle, provide an arbitrarily polarized endfire antenna. Also, the waveguide need not be terminated in a matched load because the field at the open end of the waveguide would be of the same phase and polarization as the radiation from the slots. See FIG. 9. Perhaps the dielectric could be extended (like a short polyrod) and may be tapered for better impedance match to space.

S. Cornbleet, "The Helical Slot Antenna," presented at IEEE Third Int. Conf. Antennas Propagat., ICAP '83, P.1. has reported on a novel continuous helical slot antenna in transverse electromagnetic (TEM) coaxial line which is the dual of the continuous helical wire antenna. The TEM coaxial line corresponds to the zero'th order circumferential mode. The Cornbleet helical slot, in a sense, creates a helical current sheet on the outside of the coaxial line which resembles that described in this description for the m$=1$ mode. A continuous helical slot in a waveguide cut along a current flow line of the mode of one sense has very little effect on that mode but will cause strong radiation from the mode of opposite sense. This helical slot would approximately follow a constant phase contour for the radiated mode (as discussed above, this would be exactly true when $|\alpha|=|\alpha_{ph}|$ and ($\lambda_g=\lambda_c$) which would tend to undo the circumferential phase variation for a single helix. However, if multifilar helices were used, the circumferential phase variation would be retained because there would be the proper phase progression from helix to helix in the $\phi-$ direction while the proper axial phasing would be retained for endfire radiation.

The endfire pattern would be single sense circularly polarized.

There are a few examples of possible antenna configurations that are suggested by the current flow lines and constant phase contours for TE to z modes in circular waveguide. All transverse magnetic (TM) to z modes have longitudinal currents only because $\bar{n}\times\bar{H}$ has a z-component only.

A slot that is oriented such that it couples to only one circulating wave will cause a backward and forward scattering of that circulating wave propagating down the waveguide. For the ideal case, both the backward scattered (reflected) wave and the forward scattered wave have current flow lines that are parallel to those of the incident wave. That is, the screw sense of the scattered waves remain the same as that of the incident wave. Hence, in the design of such waveguide slot arrays, coupling to the opposite circulating wave can be largely ignored and the usual methods of slot array design can be used. However, a planar short circuit across the waveguide will reflect a wave of the opposite sense. A symmetrical imperfect terminating load would also reflect the opposite sense. If a standing wave or resonant slot array of the configuration using the dominant $m=1$ ($TE_{11}$) mode of FIGS. 6, 7, and 8 is to be designed, a simple transverse planar short circuit will not work. Instead a polarization reversing short as described before must be used. This type of short circuit reverses the polarization of the normally reflected wave to make it the same screw sense as the incident wave; hence, the slots will couple to this reflected wave and a standing wave array of the usual kind can be designed.

In any application where the slot is designed to couple to one sense and it is undesirable to have any of the opposite sense present, slots that do couple to the undesirable sense can be used as an absorption filter to eliminate the undesirable sense. This can be done by filling or backing these slots with absorbing material 60 such as that shown in FIG. 6.

A circular waveguide has primarily been discussed above, however, the invention may also be embodied in a coaxial waveguide 62 such as that shown in FIG. 6.

An antenna designed in accordance with the invention may find application to simple line source antenna uses where polarization agility is desired. For example, electronic warfare, communications, beacon, and direction finding uses may all find an antenna made in accordance with the invention applicable.

The above description is presented by way of example only. Changes in form and details may occur to one skilled in the art without departing from the scope of the invention. It is intended that the invention be limited only by the scope of the appended claims.

What is claimed is:

1. A slotted waveguide antenna for providing a beam of energy, the pattern of which may be varied, comprising:

a circular waveguide through which energy of a circumferential mode equal to or greater than may be propagated, said energy having current flow lines which are helical in relation to said waveguide, said propagated energy including energy of a first circulating mode and energy of a second circulating mode;

a first slot formed in said waveguide and being oriented such that the long dimension of said slot is at an angle of greater than zero degrees with respect to the helical currents of said energy of a first circulating mode and the long dimension of said slot is parallel to the helical currents of said energy of a second circulating mode;

a second slot formed in said waveguide and being oriented such that the long dimension of said slot is at an angle of greater than zero degrees with respect to the helical currents of said energy of a second circulating mode and the long dimension of said slot is parallel to the helical currents of said energy of a first circulating mode;

mode transducer means for feeding the circular waveguide with orthogonally polarized modes of the energy to be propagated;

circular polarizer means for circularly polarizing the energy propagated through the circular waveguide; and control means for controlling the relative amplitudes and phases of the energy applied to the orthomode transducer so that the pattern of the beam may be varied.

2. The slotted waveguide antenna of claim 1 further comprising:

a first array of slots formed in said waveguide which are separated from each other by approximately the distance of $\lambda_g$ and are oriented substantially the same as said first slot and are aligned therewith;

a second array of slots formed in said waveguide which are separated from each other by approximately the distance of $\lambda_g$ and are oriented substantially the same as said second slot and are aligned therewith.

3. The slotted waveguide antenna of claim 1 wherein said control means comprises:

splitter means for splitting said energy to be applied to said mode transducer means into two parts;

coupling means for applying one part of said split energy to a first port of said mode transducer means and for applying the second part of said split energy to a second port of said mode transducer means; and phase control means for controlling the phase of energy fed through one of the ports of said mode transducer means.

4. The slotted waveguide antenna of claim 1 wherein said circular waveguide comprises coaxial waveguide.

5. The slotted waveguide antenna of claim 1 wherein selected slots are coupled to absorption means for absorbing energy coupled by said selected slots.

6. The slotted waveguide antenna of claim 1 wherein said waveguide is dielectically loaded whereby energy may be propagated in an endfire direction.

7. The slotted waveguide antenna of claim 1 wherein the first and second slots are positioned in relation to each other such that they form crossed slots.

8. The slotted waveguide antenna of claim 2 wherein the first array of slots and the second array of slots are positioned in relation to each other that they form crossed slots.

9. The slotted waveguide antenna of claim 2 wherein said control means comprises:

splitter means for splitting said energy to be applied to said mode transducer means into two parts;

coupling means for applying one part of said split energy to a first port of said mode transducer means and for applying the second part of said split energy to a second port of said mode transducer means; and phase control means for controlling the phase of energy fed through one of the ports of said mode transducer means.

10. The slotted waveguide antenna of claim 2 wherein the circular waveguide has an end at which is disposed a short circuit means for providing a polarization reversing short circuit to the energy propagating in the waveguide.

11. A slotted waveguide antenna for providing a beam of energy, the pattern of which may be varied, comprising:

a circular waveguide through which energy of a circumferential mode equal to or greater than may be propagated, said energy having current flow lines which are helical in relation to said waveguide, said propagated energy including energy of a first circulating mode and energy of a second circulating mode;

a first array of slots formed in said waveguide and being oriented such that the long dimension of said slots is at an angle of greater than zero degrees with respect to the helical currents of said energy of a first circulating mode and the long dimension of said slots is parallel to the helical currents of said energy of a second circulating mode;

a second array of slots formed in said waveguide and being oriented such that the long dimension of said slots is at an angle of greater than zero degrees with respect to the helical currents of said energy of a second circulating mode and the long dimension of said slots is parallel to the helical currents of said energy of a first circulating mode;

mode transducer means for feeding the circular waveguide with orthogonally polarized modes of the energy to be propagated;

circular polarizer means for circularly polarizing the energy propagated through the circular waveguide; and control means for controlling the relative amplitudes and phases of the energy applied to the orthomode transducer so that the pattern of the beam may be varied.

12. The slotted waveguide antenna of claim 11 wherein the circular waveguide has an end at which is disposed a short circuit means for providing a polarization reversing short circuit to the energy propagating in the waveguide.

13. The slotted waveguide of antenna of claim 11 wherein the first array of slots and the second array of slots are positioned in relation to each other such that they form crossed slots.

14. The slotted waveguide antenna of claim 11 wherein said control means comprises:

splitter means for splitting said energy to be applied to said mode transducer means into two parts;

coupling means for applying one part of said split energy to a first port of said mode transducer means and for applying the second part of said split energy to a second port of said mode transducer means; and phase control means for controlling the phase of energy fed through one of the ports of said mode transducer means.

* * * * *